US006611671B2

(12) United States Patent
Shoji

(10) Patent No.: US 6,611,671 B2
(45) Date of Patent: Aug. 26, 2003

(54) IMAGE FORMING APPARATUS

(75) Inventor: Takeo Shoji, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/916,593

(22) Filed: Jul. 30, 2001

(65) Prior Publication Data

US 2002/0018670 A1 Feb. 14, 2002

(30) Foreign Application Priority Data

Aug. 2, 2000 (JP) ..... 2000-234929

(51) Int. Cl.[7] ..... G03G 21/00
(52) U.S. Cl. ..... 399/346
(58) Field of Search ..... 399/346, 350

(56) References Cited

U.S. PATENT DOCUMENTS

| | | | | |
|---|---|---|---|---|
| 4,757,349 A | * | 7/1988 | Toshimitsu et al. | 399/102 |
| 5,162,858 A | | 11/1992 | Shoji et al. | 355/299 |
| 5,204,034 A | | 4/1993 | Sasame et al. | 264/138 |
| 5,646,718 A | * | 7/1997 | Suwa et al. | 399/350 |
| 5,819,147 A | | 10/1998 | Shoji | 399/284 |

FOREIGN PATENT DOCUMENTS

| | | | |
|---|---|---|---|
| JP | 6-44180 | | 6/1994 |
| JP | 6-58585 | | 8/1994 |
| JP | 8-50393 | * | 2/1996 |
| JP | 8-123279 | | 5/1996 |

* cited by examiner

*Primary Examiner*—Quana M. Grainger
(74) *Attorney, Agent, or Firm*—Fitzpatrick, Cella, Harper & Scinto

(57) ABSTRACT

An image forming apparatus includes an image bearing member, an electrifying device for electrifying the image bearing member, and a transferring member provided with a contact portion contacting with the image bearing member. The transferring member causes the contact portion to make a transferring material pass by to thereby transfer a toner image formed on the image bearing member to the transferring material. A length of the transferring member in the lengthwise direction of the image bearing member is shorter than a length of an electrification area in which the electrifying device electrifies the image bearing member. A cleaning blade contact with the image bearing member to remove residual toner from the image bearing member. The image forming apparatus further includes a lubricant imparting device for imparting a lubricant to surface areas of the image bearing member in the lengthwise direction, which are outside the transferring member and correspond to the end portions of the cleaning blade. Lubricant is not applied to a surface area corresponding to a position when the transferring member contacts with the lubricant forming member.

15 Claims, 8 Drawing Sheets

IMAGE FORMING APPARATUS

BACKGROUND OF THE INVENTION

1. Field of the Invention

This invention relates to an image forming apparatus, and particularly to an image forming apparatus in which the surface of an image bearing member is adapted to be cleaned by a cleaning blade.

2. Related Background Art

In some image forming apparatuses according to the prior art, a toner residual on the surface of an image bearing member after a toner image formed on the surface of the image bearing member has been transferred to a transferring material is adapted to be removed by a cleaning blade. FIG. 5 of the accompanying drawings schematically shows the construction of the image forming portion of such an image forming apparatus according to the prior art, and in FIG. 5, the reference numeral 1 designates an image bearing member. This image bearing member 1 is adapted to be rotatively driven in the direction of arrow a by driving means, not shown.

Also, around this image bearing member 1, there are disposed a primary contact electrifying roller 2 which is electrifying means (electrifying member) for electrifying the surface of the image bearing member 1 to uniform potential, a developing apparatus 5 which is developing means for causing a toner to adhere to an electrostatic latent image formed on the surface of the image bearing member 1 and forming a toner image thereon, a cleaning apparatus 8 for removing any toner residual on the surface of the image bearing member 1, etc.

In FIG. 5, the reference numeral 11 denotes a process cartridge compactly containing the image bearing member 1, the primary contact electrifying roller 2, the developing apparatus 5, the cleaning apparatus 8, etc. in a housing 9 and making them into a cartridge, and this process cartridge 11 is detachably mounted with resect to the image forming apparatus. Also, the reference numeral 10 designates a transfer electrifying roller which is a transferring member for transferring the toner image on the surface of the image bearing member onto a transferring material P, and this transfer electrifying roller 10 is adapted to contact with the image bearing member 1 when the process cartridge 11 is mounted.

In the thus constructed image forming apparatus, exposure light L from exposing means, not shown, is applied to the image bearing member 1 having had its surface electrified by the primary contact electrifying roller 2 to thereby form an electrostatic latent image on the surface of the image bearing member 1, whereafter this electrostatic latent image is developed by the developing apparatus 5 to thereby form a toner image on the image bearing member.

Thereafter, the toner image is transferred onto the transferring material P passing through the nip between the transfer electrifying roller 10 and the image bearing member 1, by the transfer electrifying roller 10. The transferring material P onto which the toner image has thus been transferred is thereafter conveyed to a fixing apparatus, not shown, and is heated and pressurized in this fixing apparatus, whereby the toner image is fixed.

Now, the developing apparatus 5, as shown in FIG. 5, is provided with a developing sleeve 3 rotated in the direction of arrow b for carrying the toner, not shown, and an elastic blade 4 for regulating the thickness of a toner coat on the developing sleeve 3. Also, the cleaning apparatus 8 is provided with a cleaning blade 6 (hereinafter referred to as the blade) supported by a supporting member 13 to scrape off any untransferred toner from the image bearing member 1, a dip sheet 7 for collecting the scraped-off untransferred toner, and a cleaner container 8*a* for containing the scraped-off toner therein.

Further, as shown in FIG. 6 of the accompanying drawings, cleaning end portion seals 14 which are seal members formed of an elastic material such as foamed polyurethane are provided on the opposite end portions of the blade 6 on the cleaner container with the gaps thereof with respect to the blade 6 made infinitely small so as not to leak the scraped-off toner from the cleaner container 8*a*. That is, the area which can collect the toner in the cleaning apparatus 8 is an opening portion (toner collecting opening) surrounded by the blade 6, the dip sheet 7 and the blade end portion seals 14 which is indicated by a halftone portion.

As the blade 6 of this cleaning apparatus 8, urethane rubber is often used usually from the viewpoint of durability, but urethane rubber is high in degree of adhesion and bad in slidability and therefore, a lubricant such as silicon resin fine particles or fluorine particles is applied to the edge portion of the blade (the fore end portion of the blade) which is the portion of contact with the image bearing member 1 to thereby obtain lubricity.

Now, in the prior-art image forming apparatus provided with such a blade 6, the lubricant may come off the blade 6 in some cases, and when the lubricant thus comes off, the friction between the blade 6 and the image bearing member 1 becomes great.

When the friction becomes great as described above, the blade 6 comes to receive a force in the direction of arrow F indicated in FIG. 5 because it abuts against the surface of the image bearing member 1 in a counter direction, whereby the blade edge is reversed in the direction of arrow F and turn-up of the blade 6 occurs. That is, the blade 6 obtaining lubricity by having a lubricant applied thereto will instantly cause turn-up thereof particularly under high temperature and high humidity if the lubricant comes off.

Description will now be made of the cause for the coming-off of this lubricant.

If the material of the blade 6 is urethane rubber, when the electrification polarity of the blade 6 frictionally sliding with respect to the image bearing member 1 is measured, the blade 6 is electrified to the plus polarity. On the other hand, silicon resin fine particles or fluorine particles which are the lubricant are electrification-serially minus, but the lubricant present in the form of fine particles is often minus by triboelectrification as a matter of course, and because of triboelectrification, there are also present fine particles electrified to plus. Consequently, the plus-electrified blade 6 retains the minus-electrified lubricant thereon, but conversely electrically repels the plus-electrified fine particles, whereby the lubricant tries to come off the blade 6.

On the other hand, for example, in a reversal developing system, when a toner electrified to minus is used, the primary contact electrifying roller 2 effects minus electrification and the transfer electrifying roller 10 effects plus electrification.

That is, in the reversal developing system, the toner is used for development in a portion lowered in electrification potential by being exposed and therefore, design is made such that in the opposite end portions which are not desired to be toner-developed, the primary electrification area width is secured widely and minus electrification is effected so that the toner may not be used for development. Accordingly, as shown in FIG. 7 of the accompanying drawings, the primary contact electrifying roller 2 is greater in length than the transfer electrifying roller 10.

Here, paying attention to the electrification potential of the surface of the image bearing member, the hatched portions of the surface of the usually minus-electrified image bearing member (organic photosensitive drum) which are shown in FIG. 7 are always minus-electrified by the primary contact electrifying roller 2. In contrast, the surface potential does not become uniform in that range of the surface of the image bearing member which is electrified by the transfer electrifying roller 10, but is electrified substantially plus after that range has passed the transfer electrifying roller 10.

In the lengthwise range which is thus electrified by the transfer electrifying roller 10, the surface of the image bearing member is plus-electrified, but the minus-electrified lubricant both electrically and physically firmly adheres to the plus-electrified blade 6 and does not come off.

However, in the primary electrification areas at the opposite ends of the transfer electrifying roller 10 which the electrification by the transfer electrifying roller 10 does not reach, the lubricant comes off because the surface potential of the image bearing member 1 is minus potential and in addition, the plus-electrified lubricant is repelled from the blade 6 electrified to electrically plus.

This lubricant having come off adheres to the primary contact electrifying roller 2 and contaminates the primary contact electrifying roller 2. The lubricant which has not adhered to the primary contact electrifying roller 2 again returns to the cleaning apparatus 8 if it does not adhere to the transferring material P, but in most cases, it is scraped off by the blade 6 and is collected into the cleaner container 8*a* and therefore is not useful as the lubricant.

The cause for turn-up of the blade will now be described with reference to FIGS. 8 and 9 of the accompanying drawings. FIG. 8 is a cross-sectional view of the transfer electrification area of the image bearing member 1, and FIG. 9 is a cross-sectional view of the primary electrification area outside the transfer electrification area of the image bearing member 1. Also, in these figures, ○ indicative of the polarities indicates the lubricant, and the other polarities are indicative of the surface potential of the image bearing member 1 and the electrification potential of the blade 6.

Here, the opposite end portions of the primary contact electrifying roller 2 are brought into pressure contact with the surface of the image bearing member by springs, not shown, whereby the primary contact electrifying roller 2 is driven to rotate with the rotation of the image bearing member 1. In this case, the pressure force of the springs is high in the opposite end portions of the primary contact electrifying roller 2 as compared with the central portion thereof and therefore, in the opposite end portions, the surface material of the primary contact electrifying roller 2, though slightly, is rubbed against and shifts to the surface of the image bearing member.

By the surface material of the primary contact electrifying roller 2 thus shifting to the surface of the image bearing member, the friction between the blade 6 and the surface of the image bearing member 1 becomes great and thus, the blade 6 is turned up.

Also, in the area of contact of the primary contact electrifying roller 2 with the image bearing member 1, discharge occurs to uniformly electrify the surface of the image bearing member 1. That is, a discharge product is created in the electrification area and this discharge product adheres to the surface of the image bearing member 1, whereby the lubricity of the surface of the image bearing member 1 is reduced.

In that area of the primary contact electrifying roller 2 which is the area of contact, but in which the transfer electrifying roller 10 is in contact with the surface of the image bearing member 1, the toner image, the transferring material or the transfer electrifying roller 10 itself is cleaning the surface of the image bearing member 1 and therefore, as compared with the area in which the primary contact electrifying roller 2 alone contacts, in the area wherein the transfer electrifying roller 10 is in contact with the surface of the image bearing member 1, the surface of the image bearing member 1 does not become difficult to slide.

On the other hand, in many cases, an alternating current electric field is superimposed on the primary contact electrifying roller 2 to uniformize the electrification potential, and when the alternating current electric field is superimposed like this, the image bearing member 1 and the primary contact electrifying roller 2 come to repeat attracting each other and separating from each other under the influence of the alternating current electric field, and the image bearing member 1 and the blade 6 also come to manifest similar behavior therebetween.

As a result, the fore end of the blade flaps to thereby clear the lubricant away, and when the image bearing member 1 is moved away from the blade 6, the fore end of the blade becomes erect and when in this state, drive is applied, turn-up of the blade comes to be induced and further, turn-up of the blade 6 becomes severe.

As described above, when the primary contact electrifying roller 2 and the transfer electrifying roller 10 are used, the applied agent electrically comes off the blade 6 in the electrification area of the primary contact electrifying roller 2 and outside the electrification area of the transfer electrifying roller 10, and the frictional force becomes excessively great from the portion of the blade from which the applied agent has come off and the primary contact electrifying roller 2 makes the surface of the image bearing member difficult to slide, whereby turn-up of the blade 6 is caused.

In order to solve this problem, there is an apparatus in which as shown, for example, in Japanese Patent Post-Exam Publn No. 6-44180 and Japanese Patent Post-Exam Publn No. 6-58585, lubricant supplying means is provided near the opposite end portions of a cleaning blade to which a toner is not supplied.

However, as already described, the portion from which the lubricant comes off is an area not supplied with the toner which is outside the developing area, but occurs outside the transferring area which is outside it. Accordingly, in such a case, the lubricant can be supplied to the outside of the transferring area, and the supply of the lubricant to the inside of it and the outside of the developing area is useless. If the lubricant is supplied from the edge of the developing area to the end portions of the blade 6, this lubricant may enter the image area and disturb the image.

Also, in Japanese Patent Application Laid-Open No. 8-123279, there is described an apparatus in which a lubricant is infiltrated into cleaning end portion seals on the opposite end portions of a blade to thereby supply the lubricant to the end portions of the blade. However, the apparatus of such a construction in which the lubricant is supplied from the cleaning end portion seals cannot supply the lubricant in the course of the operation and therefore suffers from a difficultly in respect to continuity.

Also, if the amount of lubricant is made great from the initial state, when excessive supply is done at a time, the lubricant scraped off by the blade 6 may leak out of the cleaner and fall onto the transferring material conveyed, because the cleaning end portion seal areas are not areas capable of collecting as the cleaner.

When the lubricant thus falls onto the transferring material, it will disturb the image, and when the lubricant falls into the image forming apparatus, it will stain the interior of the apparatus and again it will come to adhere to the transferring material.

SUMMARY OF THE INVENTION

It is an object of the present invention to provide an image forming apparatus in which good cleaning can be effected stably.

It is another object of the present invention to provide an image forming apparatus in which turn-up of a cleaning blade is prevented.

It is still another object of the present invention to provide an image forming apparatus in which a lubricant can be stably supplied to the end portions of a cleaning blade.

Further objects and features of the present invention will become more apparent from the following detailed description when read with reference to the accompanying drawings.

DESCRIPTION OF THE PREFERRED EMBODIMENTS

Some embodiments of the present invention will hereinafter be described with reference to the drawings.

Figure 1:
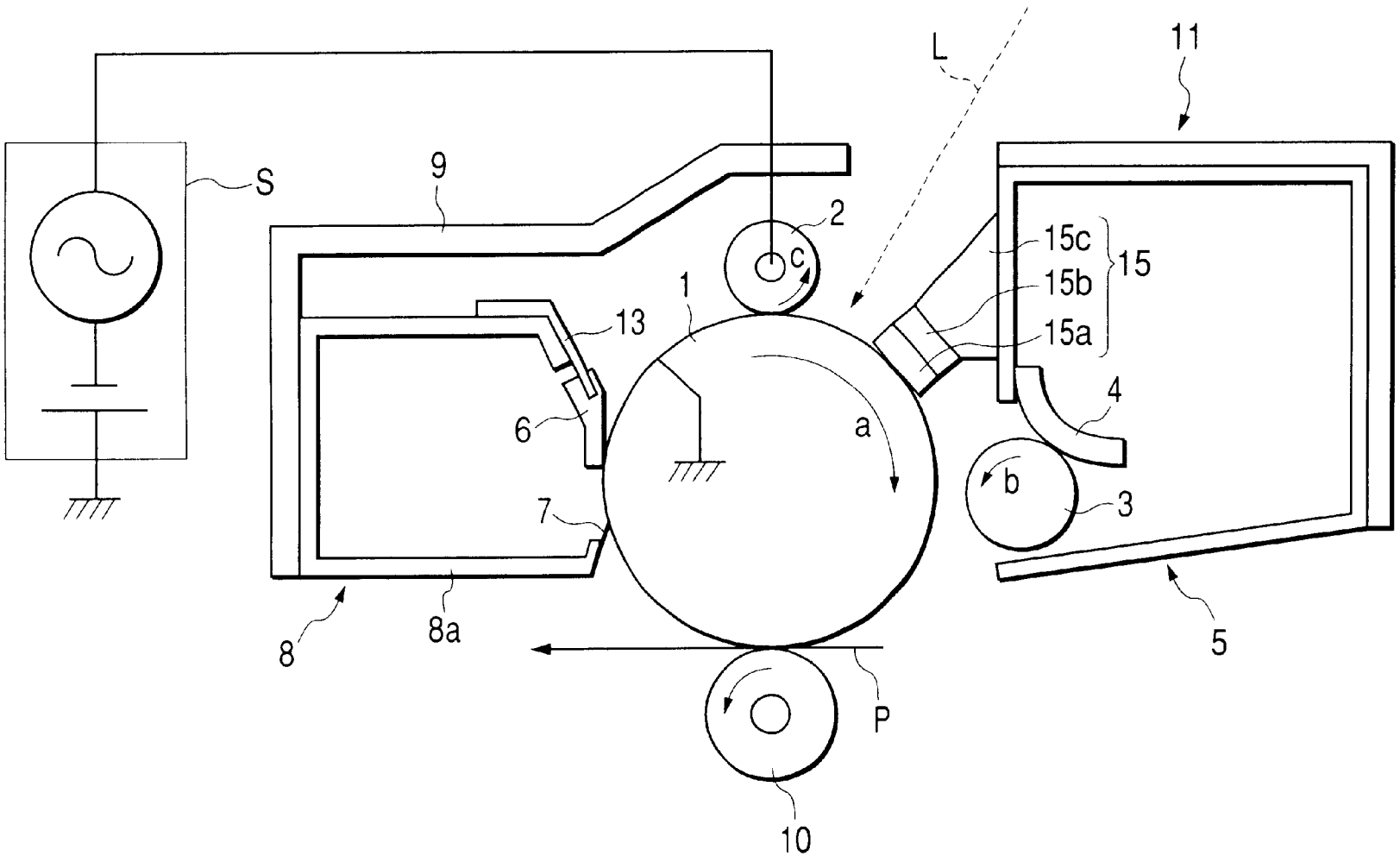
FIG. 1 schematically shows the construction of the image forming portion of an image forming apparatus according to a first embodiment of the present invention.
Figure 5:
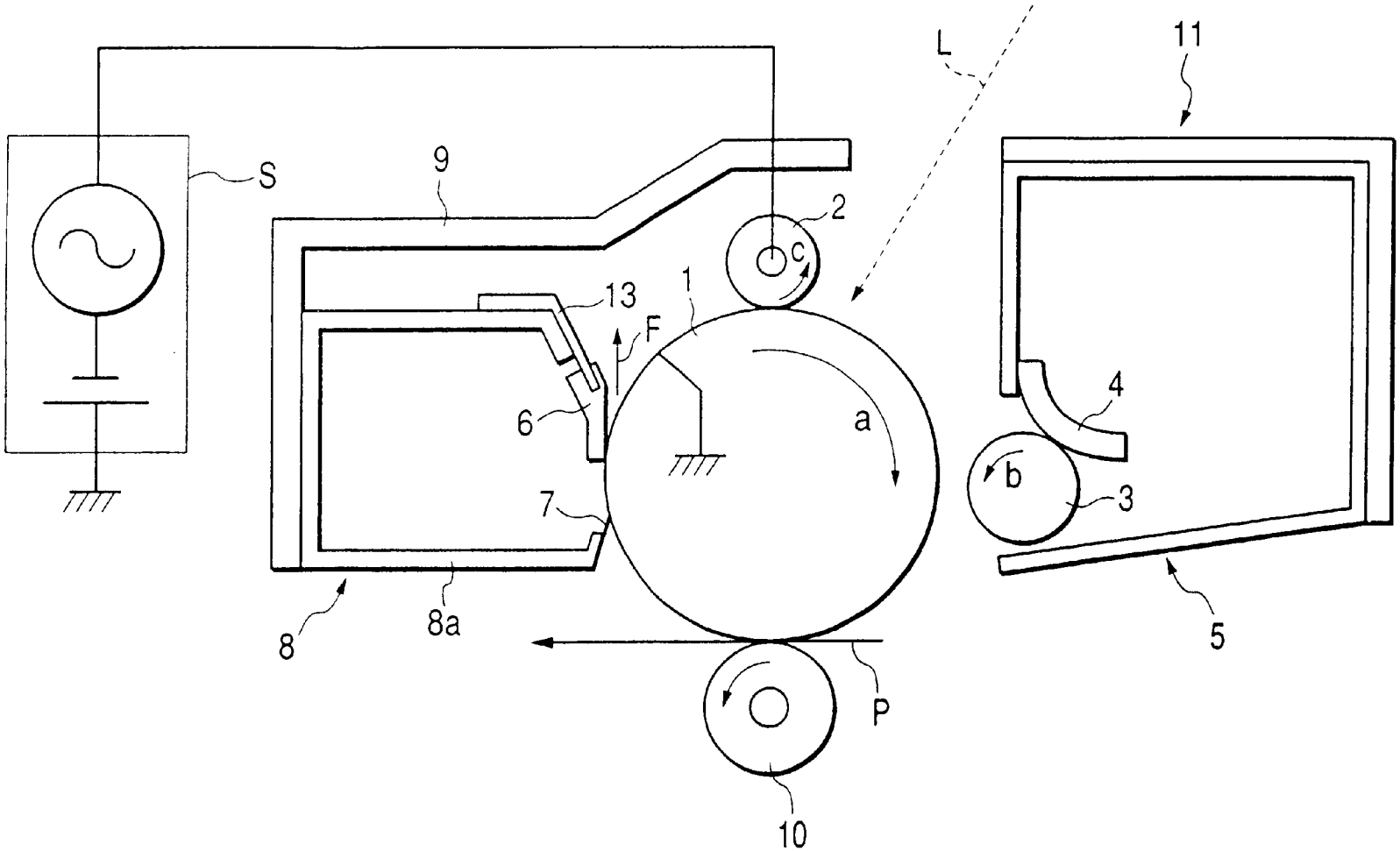
FIG. 5 PRIOR ART
FIG. 5 schematically shows the construction of the image forming portion of an image forming apparatus according to the prior art.

FIG. 1 shows the construction of the image forming portion of an image forming apparatus according to a first embodiment of the present invention. In FIG. 1, the same reference characters as those in FIG. 5 designate the same or corresponding portions.

In FIG. 1, the reference numeral 15 designates lubricating substance supplying means for supplying a lubricating substance to the surface of an image bearing member 1, and this lubricating substance supplying means 15 is comprised of a lubricating substance portion 15*a*, an elastic member portion 15*b* for electrically urging the lubricating substance portion 15*a* against the image bearing member 1, and a supporting member portion 15*c* for fixedly supporting the lubricating substance portion 15*a* and the elastic member portion 15*b*.

The lubricating substance portion 15*a* is solidified zinc stearate, wax or the like as a lubricating substance, and is adapted to be urged against the surface of the image bearing member by the elastic member portion 15*b* formed of foamed polyurethane, porous rubber or the like, at first in a state in which it abuts against the surface of the image bearing member with a moderate amount of entry. As the lubricating substance, use can be made of, besides the above-mentioned substances, fatty acid of relatively high order such as iron stearate, copper stearate, magnesium paltiminate, calcium partiminate, manganese oleate or lead oleate.

By the lubricating substance portion 15*a* being thus urged against the surface of the image bearing member, the lubricating substance portion 15*a* can always be caused to stably abut against the surface of the image bearing member 1 and supply the lubricating substance thereto even if the scraping of the lubricating substance portion 15*a* progresses with enduring.

Further, by the lubricating substance being thus supplied to the surface of the image bearing member 1, the lubricity of the blade 6 can always be kept and therefore turn-up of the blade 6 can be prevented reliably even if the lubricant electrically comes off the blade edge and even if the surface material of the primary contact electrifying roller 2 adheres to the surface of the image bearing member 1 to thereby make the image bearing member 1 difficult to slide.

In the present embodiment, the lubricating substance supplying means 15 is integrally fixed to a developing apparatus 5 located downstream of the primary contact electrifying roller 2 and upstream of the cleaning blade 6 with respect to the direction of rotation of the image bearing member, through the supporting member portion 15*c*. Thereby, the lubricating substance to be supplied can be scraped off by the blade 6 and therefore, the lubricating substance does not stain the surface of the primary contact electrifying roller 2 and the electrifying property can be prevented from lowering.

Also, as in the present embodiment, the lubricating substance supplying means 15 is integrally provided in the developing apparatus 5, i.e., in a process cartridge 11, whereby during the periodical interchange of the process cartridge 11, the interchange of the lubricating substance portion 15*a* also becomes possible and therefore, it will never happen that the lubricating substance is completely consumed and exhausted, and the lubricating property can be effectively continued and maintained.

Now, in the present embodiment, the blade 6 is formed of urethane rubber, and a voltage comprising an alternating current voltage superimposed on a minus direct current voltage is applied from a power supply portion 5 to the primary contact electrifying roller 2 which is electrifying means. Also, as regards the electrification polarity, as already described, the image bearing member 1 which is an organic photosensitive member is minus-electrified in almost all cases and therefore, minus electrification is effected on the primary contact electrifying roller 2 and in a reversal developing system, use is made of a toner minus-electrified.

Also, a plus voltage is applied to a transfer electrifying roller 10 which is a transferring member to transfer the toner from the surface of the image bearing member to a transferring material P. Thereby, on that portion of the image bearing member 1 with which the transfer electrifying roller 10 contacts and electrifies which is shown in FIG. 2, the potential of the image bearing member becomes almost plus potential, though not uniform, when the transfer electrifying roller 10 passes it.

On the other hand, the relation between the lengths in the longitudinal direction of the primary contact electrifying roller 2 and the transfer electrifying roller 10 is such that the transfer electrifying roller 10, as a matter of course, has a length in the longitudinal direction enough to cover at least the image area and corresponding to the maximum width of the transferring material for the conveyance of the transferring material P. That is, the length of the transferring roller is greater than the length of the effective developing area by the developing device.

Also, the length in the longitudinal direction of the primary contact electrifying roller 2 is greater than the maximum width of the transferring material in order that unnecessary development may not be done in the end portion areas, because in the reversal developing system, the toner does not develop that portion of the image bearing member which is electrified and the toner is used to develop that portion of the image bearing member 1 which is exposed by image exposing means 12 and is lowered in potential. Further, in order not to stain the end portions of the transfer electrifying roller 10 by unnecessary toner, the length in the longitudinal direction of the primary contact electrifying roller 2 is greater than the length of the transfer electrifying roller 10.

Figure 2:
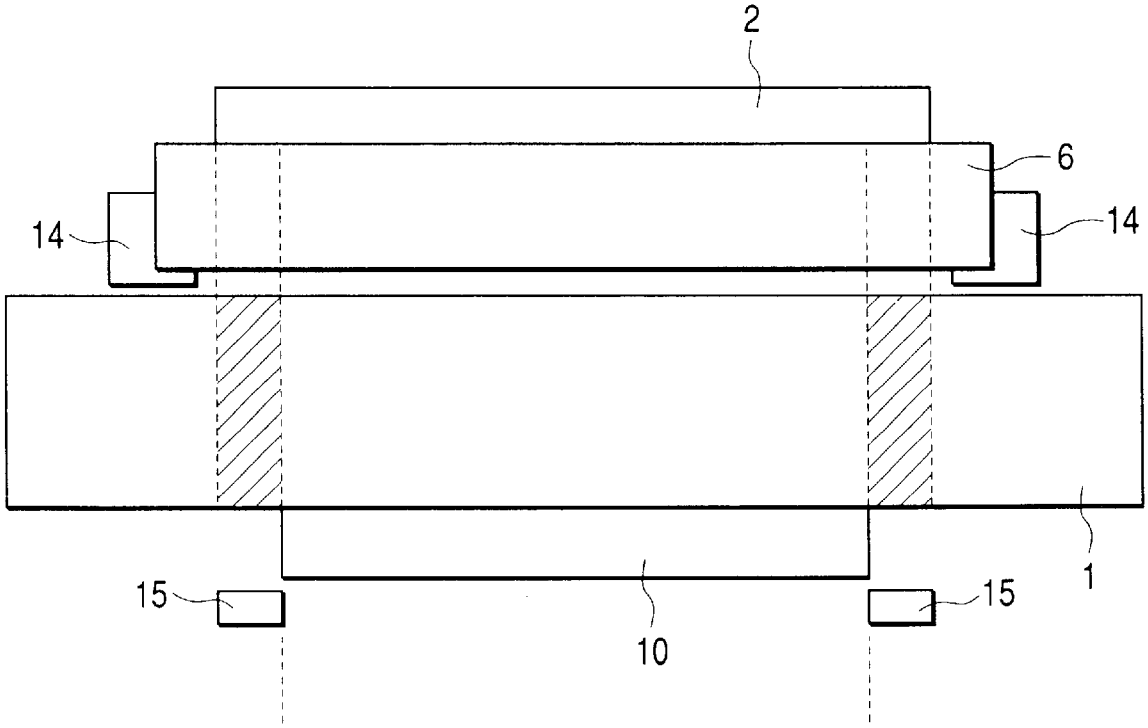
FIG. 2 shows the positional relations among the image bearing member, the primary contact electrifying roller, the cleaning blade and the transfer electrifying roller of the image forming apparatus of FIG. 1.

Accordingly, when the lengths in the longitudinal direction of the primary contact electrifying roller 2 and the transfer electrifying roller 10 are determined thus, the potential of the image bearing member is always minus potential in the hatched areas in FIG. 2 wherein the primary contact electrifying roller 2 contacts and electrifies and the transfer electrifying roller 10 does not contact.

If as described above, on the opposite end portions of the surface of the image bearing member 1, there exist areas which are minus-electrified, that is, areas inside the electrifying areas of the primary contact electrifying roller 2 indicated by hatching in FIG. 2 and outside the transfer electrifying roller 10 area, the lubricant on the end portions of the blade 6 gradually comes off the blade 6 by the reason already set forth. Also, by the discharge for uniformly electrifying the surface of the image bearing member, a discharge product is created in the electrification area and adheres to the surface of the image bearing member to thereby reduce the lubricity of the surface of the image bearing member 1.

So, in the present embodiment, the lubricating substance supplying means 15 are provided in portions corresponding to the noncontact areas of the transfer electrifying roller 10 corresponding to at least the hatched portions, and to the contact areas of the primary contact electrifying roller 2. Thereby, in spite of the coming-off of the applied agent on the blade 6 or the lowering of the lubricating of the surface of the image bearing member, the lubricant can always be supplied to the edge portion of the blade and turn-up of the blade 6 can be prevented.

If the area to be supplied with the lubricant is in the area wherein the blade 6 abuts against the image bearing member 1, the lubricating effect will be further improved. When the lubricant is supplied to the outside of the abutting area of the blade 6, the lubricant will not be scraped off by the blade and therefore, the lubricating substance will stain not only the surface of the image bearing member but also the interior of the image forming apparatus and therefore, such supply is meaningless.

However, even when design is made such that the lubricating substance is supplied to the lengthwisely outermost end portions of the blade 6, if the lubricating substance is supplied too much, in those lengthwise areas of the blade 6 which overlap the cleaning end portion seals 14, the lubricating substance will be scraped off by the blade 6 but cannot be collected into the cleaner container and will stain the interior of the image forming apparatus, because as already described, in these portions, the gap with respect to the blade 6 is set to an infinitely small value in order also to increase the sealing property.

Figure 6:
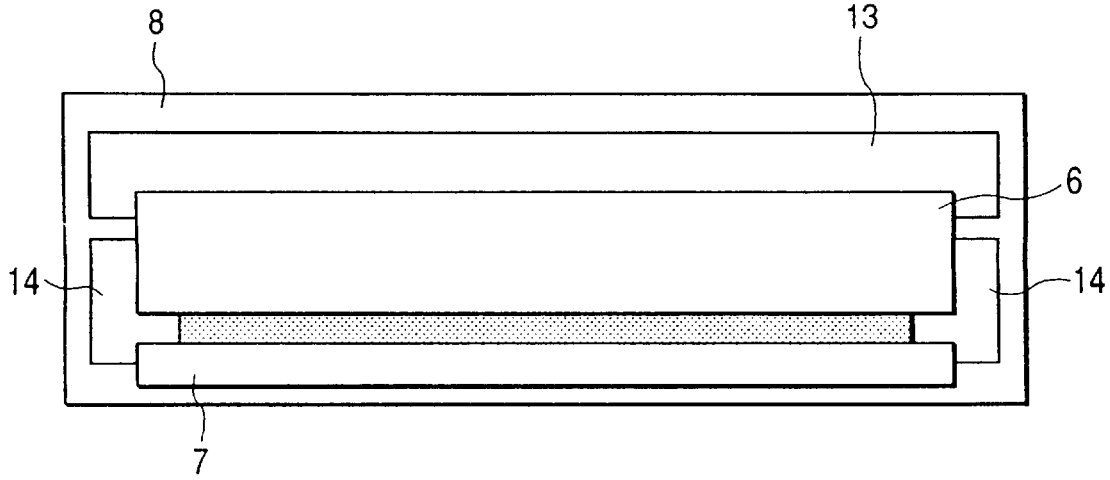
FIG. 6 PRIOR ART
FIG. 6 illustrates the construction of the cleaning apparatus of the image forming apparatus according to the prior art.
Figure 7:
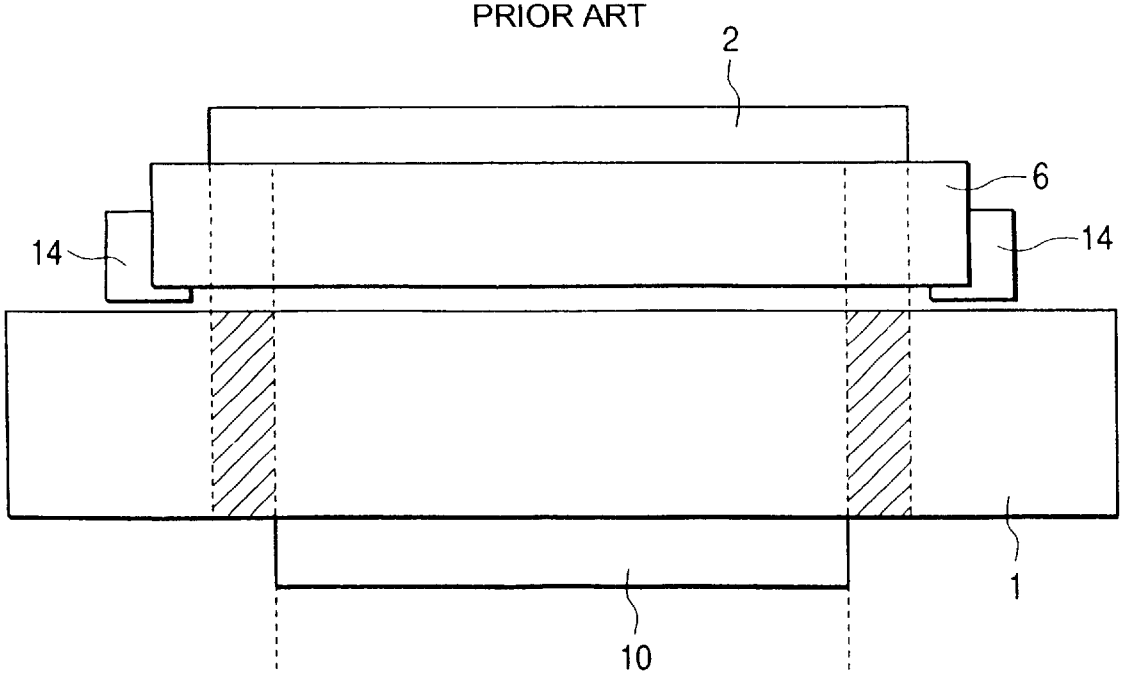
FIG. 7 PRIOR ART
FIG. 7 shows the positional relations among the image bearing member, the primary contact electrifying roller, the cleaning blade and the transfer electrifying roller of the image forming apparatus according to the prior art.
Figure 8:
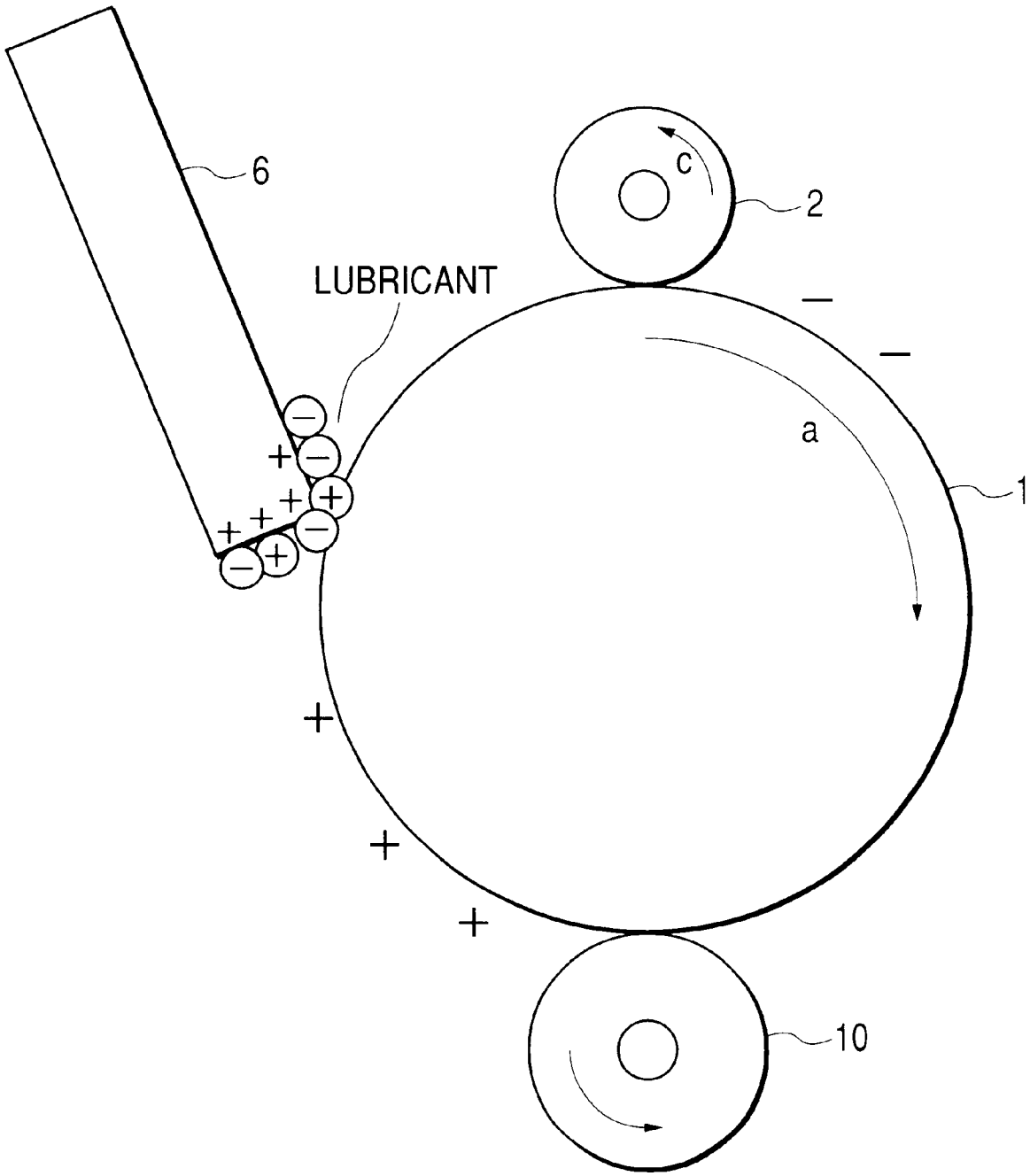
FIG. 8 is a view for illustrating the cause for the turn-up of the cleaning blade.
Figure 9:
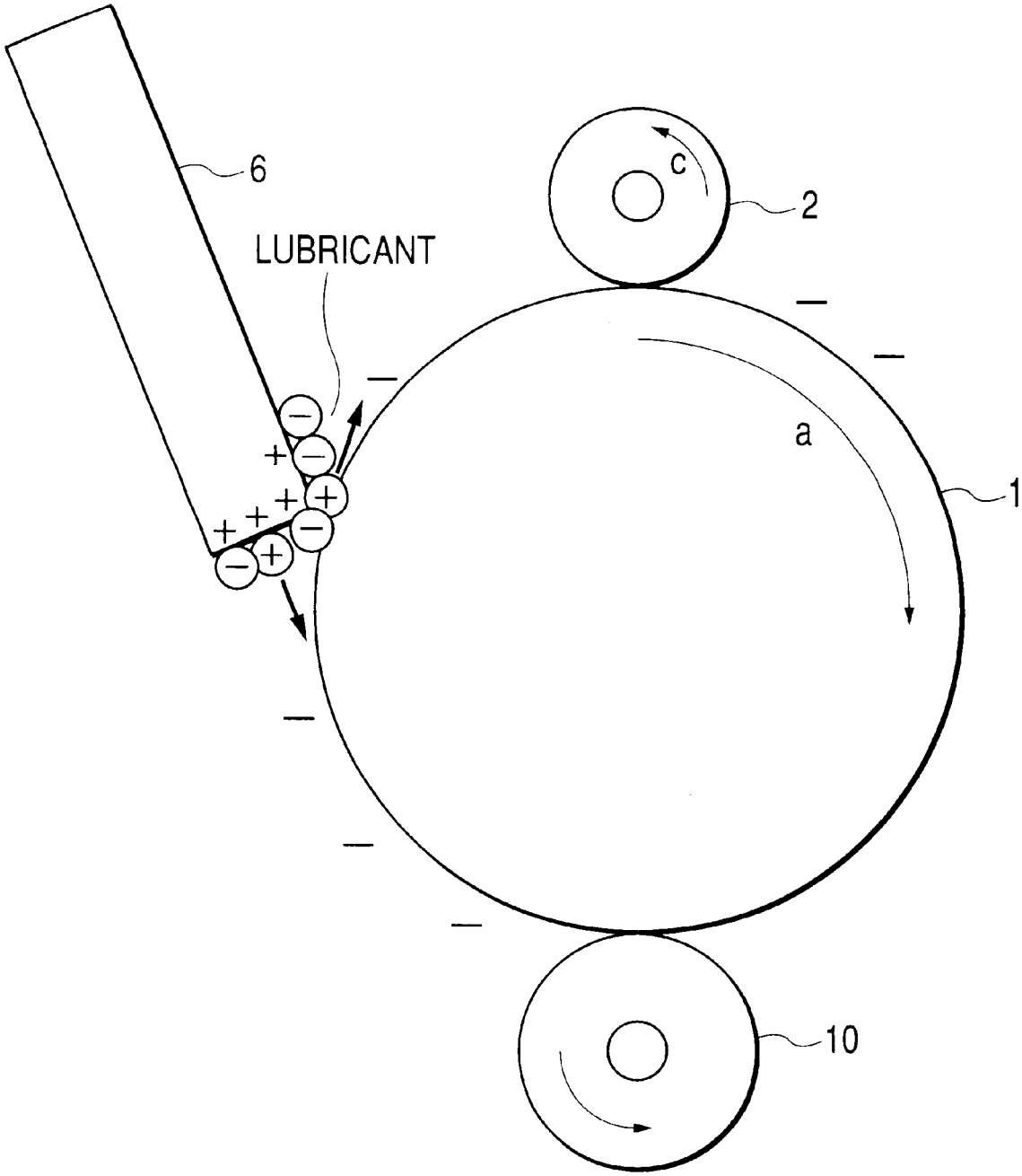
FIG. 9 is another view for illustrating the cause for the turn-up of the cleaning blade.

Accordingly, the lubricant supply areas, more preferably, may be up to the inside of the cleaning end portion seals 14 (the aforedescribed opening portion shown in FIG. 6), and if within a range in which the lubricant can be collected into the cleaner container and can be scraped off by the blade 6, the lubricating substance can be supplied in a great deal. By so constructing, the excessive lubricating substance scraped off by the blade can also be reliably collected into the cleaner container and therefore, the lubricant can be supplied and applied in a great deal without the amount thereof to be supplied being adjusted, and turn-up of the blade can be prevented more reliably.

Also, as hitherto described, the portion which causes turn-up of the blade 6 is the contact area of the primary contact electrifying roller 2 and therefore, if design is made such that the lubricating substance is concentratively supplied to this area, turn-up of the blade 6 can be prevented without waste by the necessary minimum lubricating substance, and this is effective and preferable.

The transfer electrifying roller 10 is generally constituted by a sponge roller of foamed EPDM or urethane rubber material and on the other hand, is brought into pressure contact with the image bearing member 1 with moderate contact pressure and also is usually driven with a rotational speed difference from the image bearing member 1, whereby the cleaning capability thereof is enhanced. Further, this foamed surface is effective to clean the surface of the image bearing member and therefore, in the contact area of the transfer electrifying roller 10, the surface of the image bearing member does not become difficult to slide.

As described above, the lubricating substance is positively supplied to the outside of the transfer electrified area of the surface of the image bearing member which causes turn-up of the blade 6 and at least the inside of the contact area of the primary contact electrifying roller 2 with the image bearing member 1, whereby even if the coming-off of the lubricant electrically occurs to the edge of the blade, the coefficient of friction between the blade 6 and the image bearing member 1 can be prevented from increasing excessively, and thereby turn-up of the blade 6 can be prevented.

Also, even if the lubricant having come off and the surface material of the primary contact electrifying roller 2 adhere to the surface of the image bearing member 1 to thereby make the image bearing member 1 difficult to slide, the lubricity of the blade 6 can always be kept and therefore, turn-up of the blade 6 can be prevented. Further, even if the lubricating substance portion 15*a* is scraped off and consumed, it is maintained so as to always abut against the surface of the image bearing member 1 by the elastic member portion 15*b*, whereby the lubricating effect can be maintained.

While in the description hitherto, a case where the lubricating substance supplying means 15 are provided in the process cartridge 11 (developing apparatus 5) has been described, the present invention is not restricted thereto, but if the lubricating substance supplying means 15 are provided in the developing apparatus 5 of dividable construction or the image forming apparatus, a similar effect can be obtained.

A second embodiment of the present invention will now be described.

Figure 3:
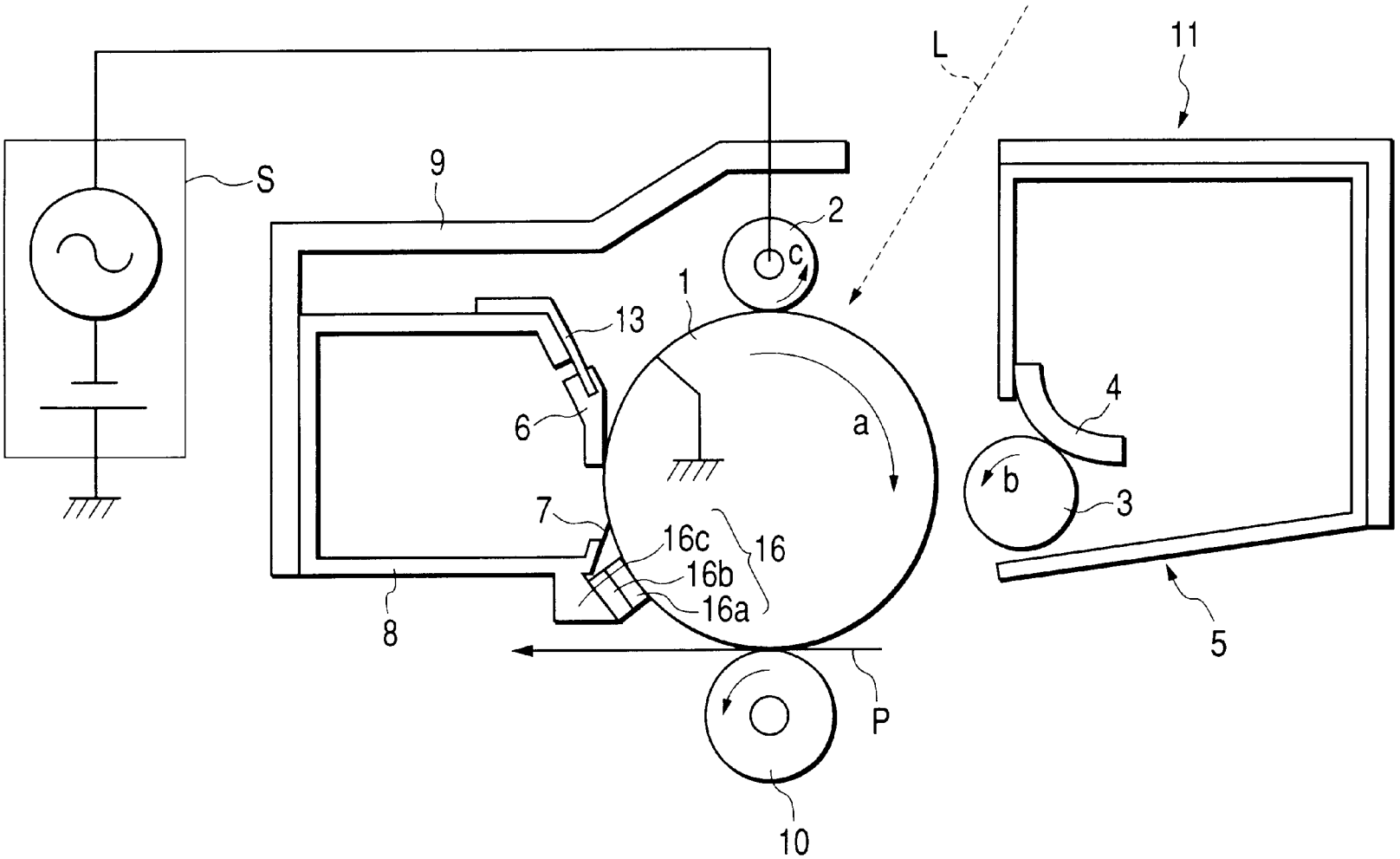
FIG. 3 schematically shows the construction of the image forming portion of an image forming apparatus according to a second embodiment of the present invention.

FIG. 3 shows the construction of the image forming portion of an image forming apparatus according to the present embodiment. In FIG. 3, the same reference characters as those in FIG. 1 designate the same or corresponding portions.

In FIG. 3, the reference numeral 16 designates lubricating substance applying means, and the lubricating substance applying means 16 is provided with a lubricating substance portion 16*a*, an elastic member portion 16*b* and a supporting member portion 16*c*. In the present embodiment, the lubricating substance applying means 16 is provided below the dip sheet 7 for collecting the toner scraped off by the cleaning apparatus 8. The relations among the installed positions of the lubricating substance applying means 16, the primary contact electrifying roller 2, the transfer electrifying roller 10 and the image bearing member 1 are as shown in FIG. 2 which has already been described.

By the lubricating substance applying means 16 being installed below the dip sheet 7 of the cleaning apparatus 8 as described above, the toner and lubricant having failed to be collected in the end portions can be caught by the surface of the upper portion of the lubricating substance applying means 16 without being dropped into the image forming apparatus and onto the transferring material. Further, if an adhesive layer is provided on the upper surface of the lubricating substance applying means 16, the toner and lubricating substance which have leaked can be caught more reliably.

Also, if such design that the cleaning portion 8 alone is interchanged is adopted, as during the interchange of the process cartridge of the already described first embodiment, the lubricating substance applying means 16 (lubricating substance portion 16*a*) is interchanged during the interchange of the cleaning portion 8, whereby the turn-up of the blade 6 can be prevented more effectively.

Further, by design being made such that the lubricating substance applying means 16 is interchanged before the catching of the toner and lubricating substance having leaked which have been caught by the upper portion of the lubricating substance applying means 16 becomes impossible, the interior of the image forming apparatus can be prevented from being stained.

In the present embodiment, the supporting member portion 16*c* is provided integrally with the cleaner container 8*a*, and by the supporting member portion 16*c* being provided integrally with the cleaner container 8*a* as described above, the abutting accuracy of the lubricating substance portion 16*a* can be improved reliably and also the number of parts is decreased, and this is advantageous in terms of cost.

Figure 4:
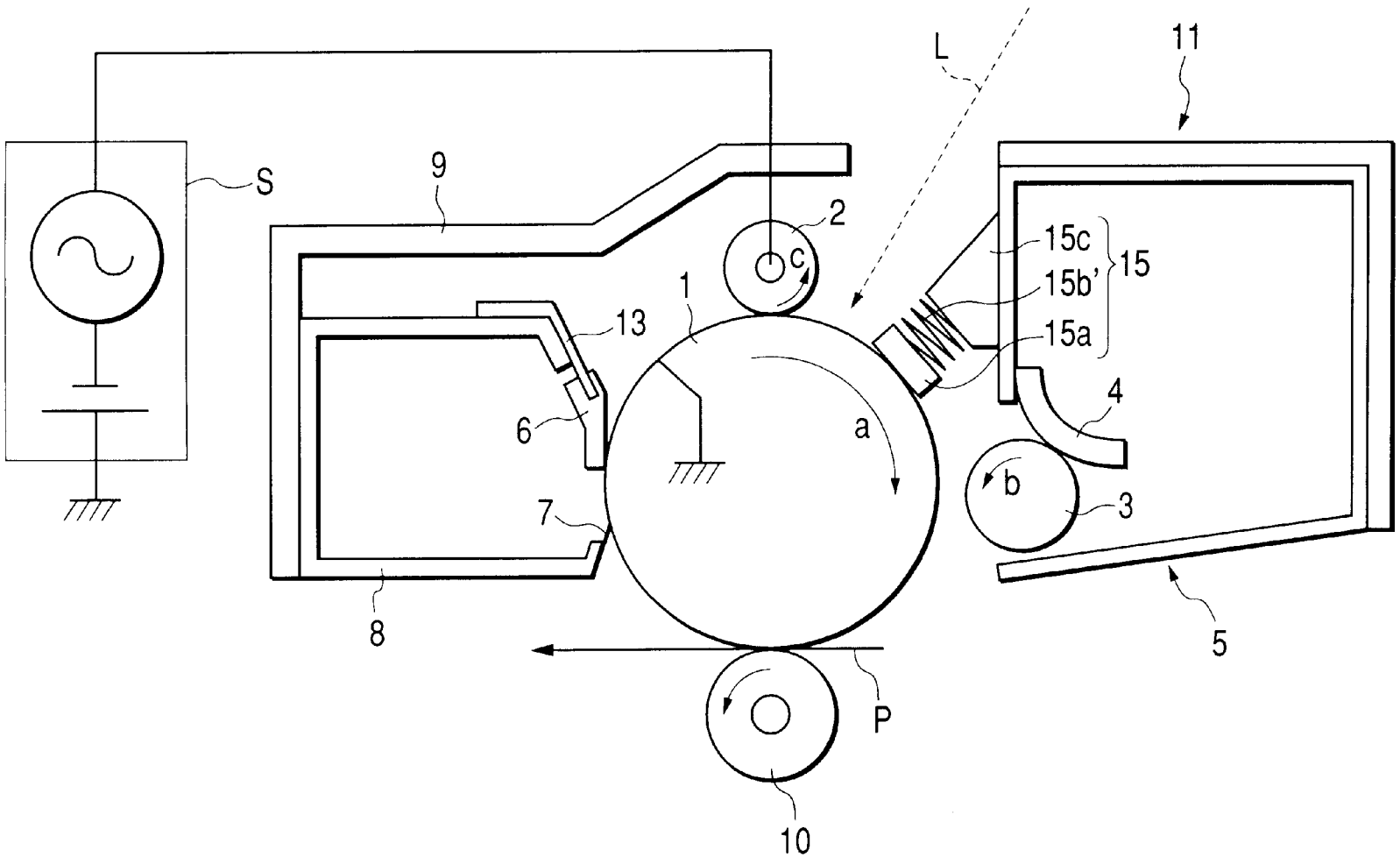
FIG. 4 schematically shows the construction of the image forming portion of an image forming apparatus according to a third embodiment of the present invention.

While in the first and second embodiments hitherto described, an elastic material such as foamed rubber or porous rubber is used as the elastic member portions 15*b* and 16*b* the present invention is not restricted thereto, but as shown, for example, in FIG. 4, the elastic member portion 15*b*' may be constituted by a spring. By the elastic member portion 15*b*' being constituted by a spring as described above, permanent deformation will not occur even if the abutting pressure is always applied, and therefore the supply of the lubricating substance can be effected stably.

As described above, according to the present embodiment, the lubricating substance is applied to the areas of the surface of the image bearing member which are outside the contact area of the transferring member and correspond to the positions near the opposite end portions of the cleaning blade by the lubricating substance applying means, whereby turn-up of the cleaning blade can be prevented and thereby, good cleaning can always be effected stably.

What is claimed is:

1. An image forming apparatus comprising:

an image bearing member;

electrifying means for electrifying said image bearing member with a voltage;

a transferring member including a contact portion contacting with said image bearing member, said transferring member causing said contact portion to allow a transferring material to pass by and to thereby transfer a toner image formed on said image bearing member to the transferring material, wherein a length of said transferring member in a lengthwise direction of said image bearing member is shorter than a length in the lengthwise direction of an electrification area in which said electrifying means electrifies said image bearing member;

a cleaning blade contacting with said image bearing member to remove residual toner from said image bearing member; and lubricant imparting means for imparting, in a circumferential direction of said image bearing member, a lubricant to said image bearing member at position other than a position where said cleaning blade contacts with said image bearing member, wherein said lubricant imparting means imparts the lubricant to surface areas of said image bearing member, which are outside said transferring member in the lengthwise direction, said surface areas corresponding to ends of said cleaning blade, and wherein said lubricant imparting means does not impart, the lubricant to a surface area of said image bearing member said area corresponding to a position where said transferring member contacts with said image bearing member.

2. An image forming apparatus according to claim 1, wherein said electrifying means includes an electrifying member contacting with said image bearing member.

3. An image forming apparatus according to claim 2, wherein said lubricant imparting means is provided downstream of said electrifying means and upstream of said cleaning blade with respect to a direction of rotation of said image bearing member.

4. An image forming apparatus according to claim 2, wherein said electrifying member is roller-shaped.

5. An image forming apparatus according to claim 2, wherein the voltage includes a direct current voltage and an alternating current voltage superimposed on each other and, wherein the voltage is applied to said electrifying member.

6. An image forming apparatus according to claim 1, wherein said surface areas in which said lubricant imparting means imparts the lubricant to said image bearing member are provided in the electrifying area.

7. An image forming apparatus according to claim 1, further comprising a container for containing toner removed by said cleaning blade, and a seal member for sealing a space between an end portion of said cleaning blade and said container, wherein said surface areas in which said lubricant imparting means imparts the lubricant to said image bearing member are inside said seal members in a longitudinal direction.

8. An image forming apparatus according to claim 1, provided with a developing device for developing an electrostatic image formed on said image bearing member with the toner, and wherein in the lengthwise direction, a length developing area of said developing device is shorter than a length of said transferring member.

9. An image forming apparatus according to claim 1, further including a developing device for developing an electrostatic image formed on said image bearing member with toner, and wherein said surface areas in which said lubricant imparting means imparts the lubricant to said image bearing member are outside a developing area of said developing device in the lengthwise direction.

10. An image forming apparatus according to claim 1, wherein said lubricant imparting means includes a lubricant portion, an elastic portion for urging said lubricant portion against said image bearing member, and a supporting portion for supporting said elastic portion.

11. An image forming apparatus according to claim 10, further including a developing device for developing an electrostatic image formed on said image bearing member with toner, wherein said supporting portion is provided in said developing device.

12. An image forming apparatus according to claim 10, further comprising a cleaning apparatus provided with said cleaning blade and a container for collecting toner removed by said cleaning blade, and wherein said supporting portion is provided in said cleaning apparatus.

13. An image forming apparatus according to claim 1, further comprising a process cartridge detachably attachable to a main body of said apparatus, said process cartridge being provided with said image bearing member, said electrifying means, and said cleaning blade.

14. An image forming apparatus according to claim 1, wherein said transferring member is roller-shaped.

15. An image forming apparatus according to any one of claims 1 to 14, wherein when the toner image formed on said image bearing member is to be transferred to the transferring material, a voltage is applied to said transferring member, and a polarity of the voltage is opposite to an electrification polarity of said electrifying means.

* * * * *

UNITED STATES PATENT AND TRADEMARK OFFICE

CERTIFICATE OF CORRECTION

PATENT NO. : 6,611,671 B2
DATED : August 26, 2003
INVENTOR(S) : Takeo Shoji

It is certified that error appears in the above-identified patent and that said Letters Patent is hereby corrected as shown below:

Column 4,
Line 64, “in” should read -- with --.

Column 5,
Lines 53 and 55, “the” (second occurrence) should be deleted.

Column 6,
Line 27, “enduring.” should read -- endurance. --.

Column 7,
Line 36, “determined thus,” should read -- thus determined, --.

Column 9,
Line 46, “the” (second occurrence) should be deleted.

Column 10,
Line 37, “position” should read -- a position --.

Signed and Sealed this

Third Day of February, 2004

JON W. DUDAS
*Acting Director of the United States Patent and Trademark Office*